US006215456B1

(12) United States Patent
Nakanishi

(10) Patent No.: US 6,215,456 B1
(45) Date of Patent: Apr. 10, 2001

(54) ANTENNA UNIT AND RADIO RECEIVER DEVICE

(75) Inventor: Hideo Nakanishi, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/366,083

(22) Filed: Aug. 3, 1999

(30) Foreign Application Priority Data

Sep. 7, 1998 (JP) ..... 10-252743

(51) Int. Cl.[7] ..... H01Q 1/36
(52) U.S. Cl. ..... 343/895; 343/702
(58) Field of Search ..... 343/702, 895, 343/741, 742, 866, 867; 235/375, 492

(56) References Cited

U.S. PATENT DOCUMENTS 5,739,792 * 4/1998 Hassemer et al. ..... 343/702
5,821,525 * 10/1998 Takebayashi ..... 235/492
5,907,306 * 5/1999 Karabinis et al. ..... 343/702
5,963,180 * 10/1999 Leisten ..... 343/895
5,982,330 * 11/1999 Koyanagi et al. ..... 343/702

* cited by examiner

*Primary Examiner*—Tan Ho
(74) *Attorney, Agent, or Firm*—Pearne & Gordon LLP

(57) ABSTRACT

In the antenna unit employed in a radio paging receiver, a helical antenna 1 which is positioned along one side of a circuit substrate 4 on which a receiver circuit 3 is mounted and has a main polarization direction formed by a single body of the helical antenna 1 in the Z-axis direction, and a dipole antenna which has a main polarization direction formed by the helical antenna 1 and the circuit substrate 4 on the Y-axis direction are constructed. The non-directional direction characteristic which has a high antenna gain in all directions in the free space by compensating null points in the directivity mutually with use of the antennas whose main polarization directions are intersected substantially orthogonally.

9 Claims, 11 Drawing Sheets

ANTENNA UNIT AND RADIO RECEIVER DEVICE

BACKGROUND OF THE INVENTION

1. Field of the Invention

The present invention relates to an antenna unit using a helical antenna employed mainly in a radio paging receiver such as a pager and a radio receiver device using the same.

2. Description of the Related Art

In the radio paging receiver such as the pager in the prior art, normally the loop antenna is used as the antenna unit. A configuration of the antenna tuning control circuit in the loop antenna for the pager in the prior art will be explained with reference to FIGS. 13 and 14.

As shown in FIG. 13, the antenna tuning control circuit is constructed such that the impedance matching circuit 102 is connected to the antenna 101, the central processing unit (CPU) 104 is connected to the control input terminal of the impedance matching circuit 102 via the low pass filter (LPF) 103, and the high frequency amplifier 105 and the mixer 106 are connected to the output terminal of the impedance matching circuit 102. The receiving frequency of the antenna 101 and the impedance matching circuit 102 can be set by inputting the control voltage from the CPU 104 after noise components are removed from the control voltage by the LPF 103. The LPF 103 consists of the resistor R1 and the capacitor C1. The received signal being set at the receiving frequency as above is amplified by the high frequency amplifier 105 and then set out to the receiver circuit including the mixer 106 at the succeeding stage.

The loop antenna employed as the antenna 101 is made up of antenna material such as metal, etc. which has a very short loop length (length about $\frac{1}{5}\lambda$ to $\frac{1}{10}\lambda$, e.g., the loop length of about 15 cm to 10 cm when the receiving frequency band is set to 280 MHz) relative to the wavelength. Therefore, since the loop antenna has a very narrow frequency bandwidth, the frequency setting is needed every receiving frequency and thus the impedance matching is performed by the impedance matching circuit 102 each time.

FIG. 14 shows a concrete configuration of the antenna 101 and the impedance matching circuit 102 shown in FIG. 13. The antenna 101 is composed of antennas L1, L2 which are formed by a circuit pattern whose equivalent circuit is given by two series-connected coils, etc. The impedance matching circuit 102 is constructed such that a variable capacitor (trimmer capacitor) TVC and a variable capacitance diode (varactor diode) DVC are connected in series, and the variable capacitance diode DVC is grounded via a resistor R2 and also grounded via a capacitor C2 to pass a high frequency component. These antennas L1, L2 are connected in parallel with the variable capacitor TVC and the variable capacitance diode DVC.

The variable capacitor TVC is provided to absorb variation of inductance of the antenna. The resonance frequency of the antennas L1, L2 can be changed by varying the capacitance to be set to the receiving frequency f0. The variable capacitance diode DVC is provided to change the receiving frequency to another receiving frequency. The receiving frequency can be set by applying the control voltage from the CPU 104 every channel. It is possible to change the receiving frequency by adjusting the impedance in this manner.

The loop antenna has the problem that, if such loop antenna is located away from the human body, reduction in the antenna gain of about 5 dB is caused at the frequency of the 280 MHz band, for example, because of lost of the body effect. In recent, applications of the radio paging receiver are broadened other than the application as the so-called "calling terminal". For example, there are applications as the information receiving terminal, the equipment controlling receiver terminal, etc. If the radio paging receiver is utilized as the information receiving terminal or the equipment controlling receiver terminal, it is often employed in a free space other than the neighborhood of the human body. In this case, improvement of the antenna gain due to the body effect cannot be expected. In addition, a null point is generated in the antenna radiation pattern since directivity of the loop antenna exhibits the 8-shaped characteristic, so that there is the case where the sufficient antenna characteristic cannot be guaranteed as the receiver.

According to a configuration of the above example in the prior art, in order to set the impedance at the receiving frequency f0, the impedance matching circuit which consists of variable capacitance elements such as the variable capacitor TVC, the variable capacitance diode DVC, etc. is needed to thus increase the configuration of the device in size. This is disadvantageous from the viewpoints of miniaturization and cost reduction by reducing the parts packaging area. In addition, in order to change the receiving frequency f0 into another receiving frequency, the receiving frequency switching circuit which can set the channel by applying the control voltage from the CPU to the variable capacitance diode DVC every change of the channel is needed. Therefore, there is the problem that both the configuration of the device and its operation become complicated. In particular, if the antenna unit is separated from the receiver to use as an external antenna unit, a control line for applying an antenna control voltage from the CPU in addition to the receiving signal transmission line is also needed. Therefore, there is caused the problem that a cable wiring becomes complicated.

In the case that the whip antenna is employed as the external antenna unit, the large size antenna which has a vertical length of 25 cm, even if the $\frac{1}{4}\lambda$ antenna is employed, for example, is required at the 280 MHz band, and ideally the whip antenna is installed on the ground plate (referred to as a "GND plate" hereinafter) such as the iron plate, etc. as the installing location. Therefore, there are the problems that not only the size of the device is increased but also the installing location of the antenna unit is restricted.

SUMMARY OF THE INVENTION

The present invention has been made in light of the above problems and it is an object of the present invention to provide an antenna unit which can be employed in an information receiving terminal, an equipment controlling receiver terminal, etc. to be employed mainly in a free space, can eliminate a complicated impedance matching circuit, a frequency varying circuit, etc., can has non-directional without a null point in a directivity, can be constructed smaller in size and lower in production cost than a loop antenna, and can assure sufficient antenna characteristics in all directions and also achieve size reduction and simplification in configuration and reduction in cost, and a radio receiver device using the same.

In order to overcome the above problems, an antenna unit set forth in first aspect of the present invention, comprising a circuit substrate on which a receiver circuit is mounted; and a helical antenna connected to the circuit substrate and arranged substantially along one side of the circuit substrate; wherein impedance of the antenna unit can be adjusted at a desired frequency by changing an angle of the helical antenna relative to the circuit substrate.

An antenna unit set forth in second aspect of the present invention, comprising a circuit substrate on which a receiver circuit is mounted; and a helical antenna connected to the circuit substrate and arranged substantially along one side of the circuit substrate; wherein impedance of the antenna unit can be set at a desired frequency by arranging the helical antenna such that an angle of the helical antenna relative to the circuit substrate is set to a predetermined value.

According to the configuration in first aspect, the non-directional antenna unit which is small in size and low in cost and has no null point can be implemented by providing the antenna unit which has the helical antenna and the circuit substrate. Also, in first aspect, since the impedance of the antenna unit can be adjusted at a desired frequency by changing an angle of the helical antenna relative to the circuit substrate, the impedance matching between the receiver circuit and the antenna unit can be achieved without a complicated impedance matching circuit and also the receiving frequency can be changed without a frequency varying circuit, etc. In addition, in second aspect, impedance matching between the antenna unit and the receiver circuit or change of the receiving frequency can be facilitated since the impedance of the antenna unit can be set at a desired frequency by arranging the helical antenna such that an angle of the helical antenna relative to the circuit substrate is set to a predetermined value.

Also, in an antenna unit set forth in third aspect, the impedance of the antenna unit can be set inductively at the desired frequency in first aspect.

According to the configuration in third aspect, since the impedance of the antenna unit can be set inductively at the desired frequency, the antenna unit can be directly connected to a circuit having capacitive impedance, e.g., an amplifier circuit provided at the input stage of the receiver circuit. In this case, the impedance matching of the antenna unit can be carried out without an impedance converting circuit. As a result, reduction in size of the unit and reduction in cost can be achieved.

An antenna unit set forth in fourth aspect of the present invention, comprising a circuit substrate on which a receiver circuit is mounted; and a helical antenna connected to the circuit substrate and arranged substantially along one side of the circuit substrate; wherein a first antenna consisting of a single body of the helical antenna and a second antenna consisting of the helical antenna and the circuit substrate are arranged such that main polarization directions of the first antenna and the second antenna are intersected substantially orthogonally.

According to the configuration in fourth aspect, since the null points of the directivity are compensated mutually by the first antenna consisting of the single body of the helical antenna and the second antenna consisting of the helical antenna and the circuit substrate, the non-directional antenna unit which can assure the sufficient antenna characteristics in all directions can be achieved. In addition, the high antenna characteristics can always be achieved regardless of the polarization plane of the arrival radio wave and the arrival direction, and particularly the stable and high receiving performance can also be assured even if the antenna unit is used in the free space.

An antenna unit set forth in fifth aspect of the present invention, comprising a circuit substrate on which a receiver circuit is mounted; and a helical antenna connected to the circuit substrate and arranged substantially along one side of the circuit substrate; wherein an amplifier provided at an input stage of the receiver circuit is directly connected to the helical antenna.

According to the configuration in fifth aspect, since the amplifier provided at the input stage of the receiver circuit is directly connected to the helical antenna and also the impedance matching of the antenna unit can be accomplished without the impedance converting circuit, reduction in size of the device and reduction in cost can be attained.

An antenna unit set forth in sixth aspect of the present invention, comprising metal plate material; and a helical antenna connected to the metal plate material and arranged substantially along one side of the metal plate material; wherein the antenna unit is provided separately from a main body of a radio receiver device in which a receiver circuit is provided, and then the antenna unit is connected to an outer side of the main body of the radio receiver device via a cable.

According to the configuration in sixth aspect, since the antenna unit having the helical antenna and the metal plate material is provided, the non-directional antenna unit which is small in size and low in cost and has no null point can be implemented. In addition, since the antenna unit is connected to the outer side of the main body of the radio receiver device via the cable, the stable and desired receiving performance can be attained irrespective of the configuration of the device.

Also, in an antenna unit set forth in seventh aspect, the impedance of the antenna unit can be adjusted at the desired frequency by changing the angle of the helical antenna relative to the metal plate material, in sixth aspect.

Also, in an antenna unit set forth in eighth aspect, the impedance of the antenna side which is detected from the top end of the cable connected to the antenna unit can be set inductively at the desired frequency, in seventh aspect.

According to the configuration in seventh aspect, as in first aspect, since the impedance of the antenna unit can be adjusted at the desired frequency by changing the angle of the helical antenna relative to the metal plate material, the impedance matching between the receiver circuit and the antenna unit can be achieved without the complicated impedance matching circuit and also the receiving frequency can be changed without the frequency varying circuit, etc.

Also, according to the configuration in eighth aspect, as in third aspect, since the inductive antenna unit can be directly connected to a circuit having capacitive impedance, e.g., the amplifier circuit provided at the input stage of the receiver circuit. In this case, the impedance matching of the antenna unit can be achieved without the impedance converting circuit. As a result, reduction in size of the unit and reduction in cost can be achieved.

A radio receiver device using an antenna unit set forth in ninth aspect of the present invention, comprising an antenna unit including metal plate material, and a helical antenna connected to the metal plate material and arranged substantially along one side of the metal plate material; wherein the antenna unit is provided separately from a main body of the radio receiver device in which a receiver circuit is provided and then the antenna unit is connected at a distance to an outer side of the main body of the radio receiver device via a cable, and an amplifier provided at an input stage of the receiver circuit is directly connected to the antenna unit.

According to the configuration in ninth aspect, the non-directional antenna unit which is small in size and low in cost. A radio receiver device using an antenna unit set forth in tenth aspect of the present invention, comprising an antenna unit including a circuit substrate on which a receiver circuit is mounted, and a helical antenna connected to the circuit substrate and arranged substantially along one side of the circuit substrate; wherein the antenna unit is provided separately from a main body of the radio receiver device and then the antenna unit is connected at a distance to an outer side of the main body of the radio receiver device via a cable.

According to the configuration in tenth aspect, the non-directional antenna unit which is small in size and low in cost and has no null point can be implemented by the antenna unit having the helical antenna and the circuit substrate. In addition, since the antenna unit is connected at a distance to the outer side of the main body of the radio receiver device via the cable, the influence of the noise can be avoided and also the stable and desired receiving performance can be assured irrespective of the configuration of the device, and has no null point can be implemented by the antenna unit having the helical antenna and the metal plate material. Also, the impedance matching of the antenna unit can be implemented without the impedance converting circuit by directly connecting the amplifier provided at the input stage of the receiver circuit to the antenna unit. In addition, since the antenna unit is connected to the outer side of the main body of the radio receiver device via the cable, the influence of the noise can be avoided and the stable and desired receiving performance can be attained irrespective of the configuration of the device.

The present disclosure relates to the subject matter contained in Japanese patent application No. Hei. 10-252743 (filed on Sep. 7, 1998) which is expressly incorporated herein by reference in its entirely.

DETAILED DESCRIPTION OF THE PREFERRED EMBODIMENTS

Embodiments of the present invention will be explained with reference to the accompanying drawings hereinafter. Examples of the antenna units employing the helical antenna are shown in the present embodiments.

[First embodiment]

Figure 1:
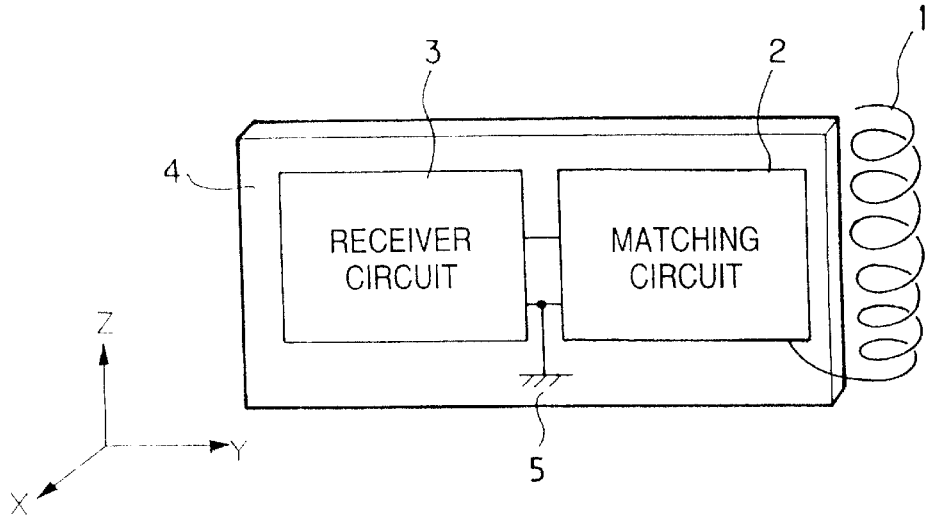
FIG. 1 is a schematic view showing a basic configuration of an antenna unit according to a first embodiment of the present invention.

FIG. 1 is a schematic view showing a basic configuration of an antenna unit according to a first embodiment of the present invention. The antenna unit is designed to be incorporated into the radio receiver device such as the radio paging receiver, etc., and comprises a helical antenna 1, an impedance matching circuit 2, a receiver circuit 3, and a circuit substrate 4. A ground (referred to as "GND" hereinafter) 5 is a ground potential for the impedance matching circuit 2 and the receiver circuit 3, and is also connected to the GND plate (earth plate) which is formed as an inner layer of the circuit substrate 4.

Figure 2:
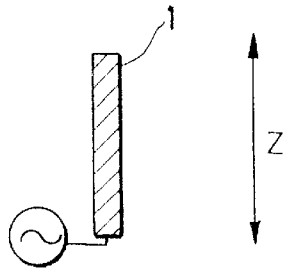
FIG. 2 is a view showing equivalently an antenna configuration consisting of a helical antenna single body.

Normally the helical antenna 1 is constructed by winding a metal wire rods (e.g., copper wire) having a length of about ¼ wavelength helically. In the radio paging receiver at the 280 MHz, the helical antenna 1 is formed by winding the copper wire of a length of about 25 cm helically. The circuit substrate 4 is positioned in parallel with a ZY plane in the coordinate system shown in FIG. 1. The helical antenna 1 is placed in parallel with the Z-axis direction along one side of four sides of the circuit substrate 4. Accordingly, the polarization direction of the helical antenna is the Z-axis direction. Thus, a first antenna which consists of a single body of the helical antenna 1 can be regarded to have a configuration shown in FIG. 2 equivalently. In this case, the Z-axis direction which is the directivity of the helical antenna 1 becomes the main polarization direction.

Figure 3:
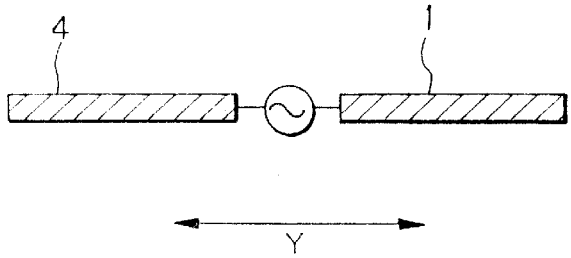
FIG. 3 is a view showing equivalently an antenna configuration consisting of a helical antenna and a circuit substrate.

Also, in FIG. 1, the helical antenna 1 and the circuit substrate 4 are formed as a pair in the Y-axis direction, and thus a dipole antenna whose one side is the helical antenna 1 and whose other side is the circuit substrate 4 can be constructed. The helical antenna 1 and the circuit substrate 4 are arranged such that both can resonate with each other at a desired frequency. A second antenna which consists of the helical antenna 1 and the circuit substrate 4 can be regarded to have a configuration shown in FIG. 3 equivalently. In this case, the main polarization direction is the Y-axis direction.

The impedance matching circuit 2 is provided to match an impedance of the helical antenna 1 with an input impedance of the receiver circuit 3. Normally the impedance matching circuit 2 is composed of a combination of a surface mounting type capacitor element and a surface mounting type inductance element. The receiver circuit 3 detects the received signal to derive communication data. The communication data are converted under control of the CPU (not shown) and are sent out to a liquid crystal display device, a buzzer, etc. to display the communication data and/or inform the user of arrival of the communication data by the sound.

As described above, the main polarization direction of the first antenna consisting of the single body of the helical antenna 1 becomes the Z-axis direction, while the main polarization direction of the second antenna which is formed of the dipole antenna consisting of the helical antenna 1 and the circuit substrate 4 becomes the Y-axis direction. Accordingly, an antenna operation by the single body of the helical antenna 1 and an antenna operation by the helical antenna 1 and the circuit substrate 4 are performed orthogonally in a ZY plane. In addition, the null point of the directivity by the helical antenna 1 is located on the Y-axis direction, while the null point of the directivity by both the helical antenna 1 and the circuit substrate 4 is located on the Z-axis direction.

Figure 4:
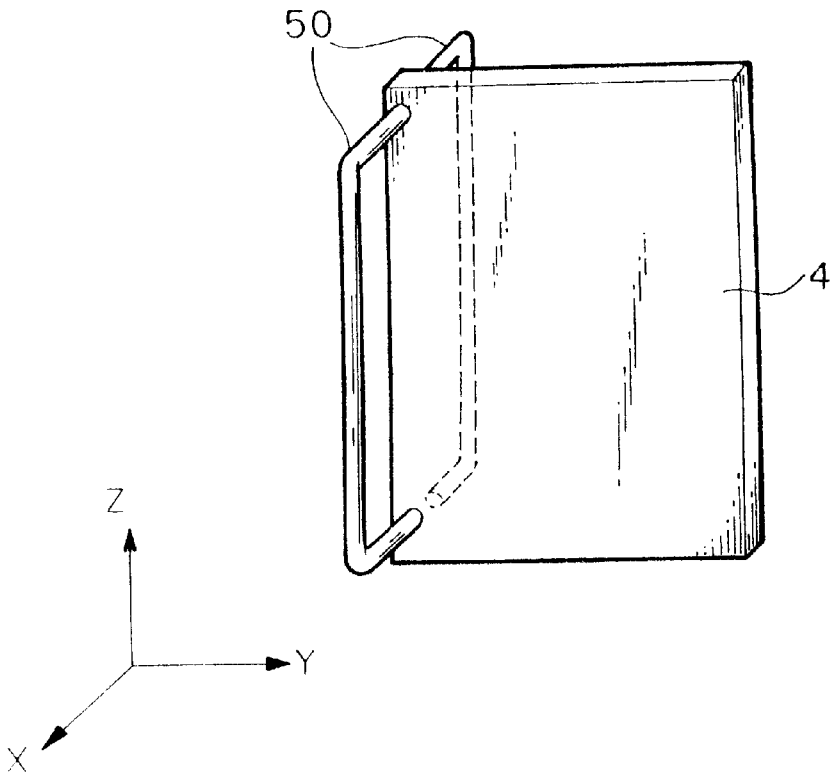
FIG. 4 is a view showing a configurational example of a loop antenna provided on the circuit substrate.

Accordingly, the directivity by the helical antenna 1 and the directivity by both the helical antenna 1 and the circuit substrate 4 for the radio wave which arrives along the ZY plane direction are compensated with each other. Because the antenna unit which is composed of the helical antenna and the dipole antenna can operate based on electric field components, such antenna unit has the higher antenna gain than the loop antenna which can operate based on magnetic field components if it is used away from the human body, i.e., in a free space. As the directivity, the antenna unit of the present embodiment exhibits the non-directional direction characteristic which has the high antenna gain in all directions so as to compensate the null point of the directivity of a loop antenna 50 provided on the circuit substrate 4, as shown in FIG. 4.

Figure 5:
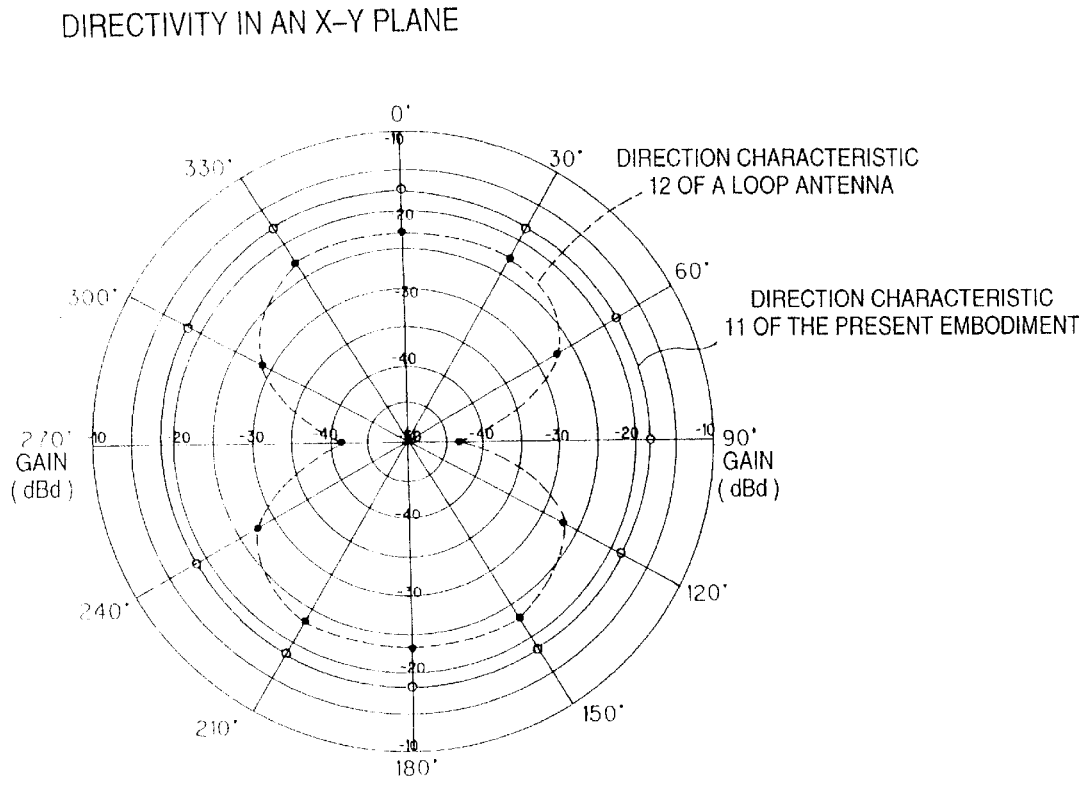
FIG. 5 is a characteristic view showing directivity of the antenna unit in an X-Y plane.
Figure 6:
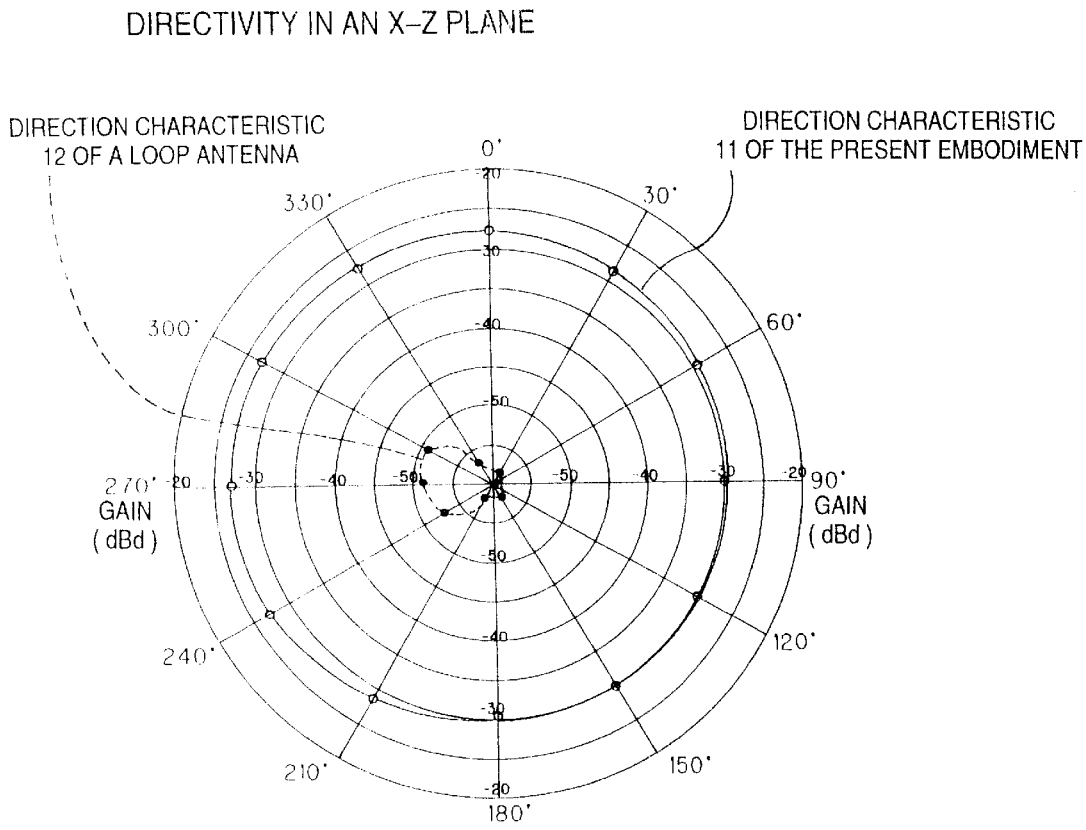
FIG. 6 is a characteristic view showing the directivity of the antenna unit in an X-Z plane.

The directivity of the antenna unit of the present embodiment is shown in FIGS. 5 and 6 respectively. FIG. 5 shows the directivity of the antenna unit for the vertically polarized wave in an X-Y plane. FIG. 6 shows the directivity of the antenna unit for the vertically polarized wave in an X-Z plane. In both the X-Y plane and the X-Z plane, the direction characteristic 11 of the present embodiment exhibits a direction characteristic which has no null point and has the high antenna gain in all directions rather than the direction characteristic 12 of the loop antenna, which is indicated by a broken line in FIGS. 5 and 6 respectively.

Also, the antenna unit of the present embodiment can have a wide bandwidth of more than 10 MHz as the antenna bandwidth (3 dB bandwidth), though not shown, and therefore can cover sufficiently the frequency bandwidth utilized in the radio paging receiver without a frequency varying circuit consisting of the variable capacitance diode, etc.

As described above, according to the configuration of the present embodiment, the high antenna characteristics can always be achieved regardless of the polarization plane of the arrival radio wave and the arrival direction, and particularly the stable and high receiving performance can also be assured even if the antenna unit is used in the free space. Also, the frequency varying circuit consisting of the variable capacitance diode, etc. is not needed to change the receiving frequency. As a result, there can be provided the non-directional and high performance antenna unit which can achieve the sufficient antenna characteristic over all directions by using the small and simple configuration.

[Second embodiment]

Figure 7:
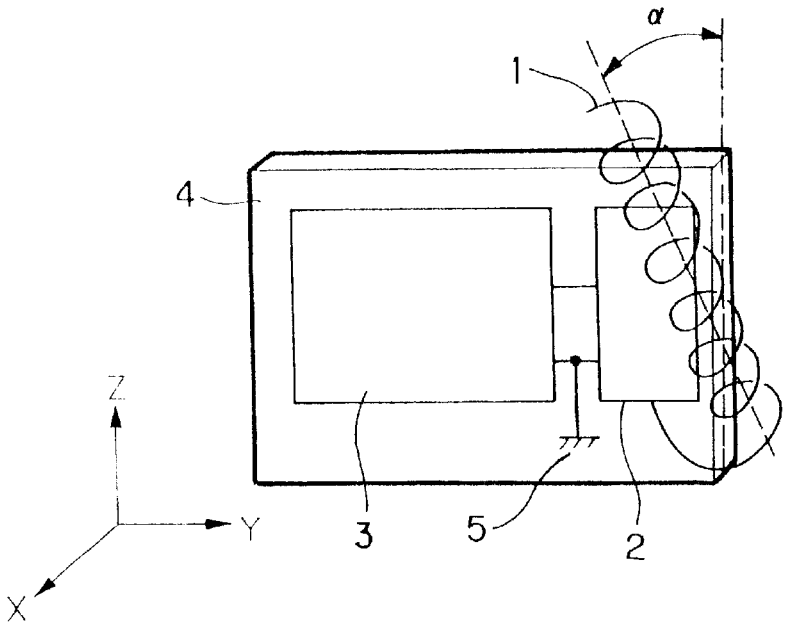
FIGS. 7*a* and 7*b* are is a schematic view showing a basic configuration of an antenna unit according to a second embodiment of the present invention.
Figure 7:
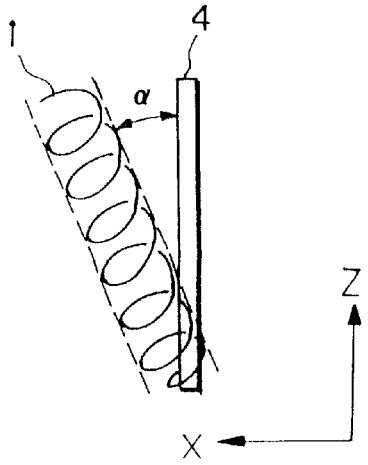

FIG. 7 is a schematic view showing a basic configuration of an antenna unit according to a second embodiment of the present invention. In FIG.7, (a) is a perspective view of the antenna unit, and (b) is a side view which is viewed from the end surface side of the circuit substrate, on which the helical antenna is provided.

The antenna unit comprises a helical antenna 1, a matching circuit 2, a receiving circuit 3, and a circuit substrate 4. A GND 5 is ground potential for the matching circuit 2 and the receiving circuit 3 and is also connected to a GND plate which is formed as the inner layer of the circuit substrate 4. A basic configuration of the helical antenna 1 is similar to that in the first embodiment and therefore its detailed explanation will be omitted.

The helical antenna 1 of the second embodiment is arranged to be tilted relative to one side of four sides of the circuit substrate 4, which is positioned in parallel with the ZY plane, by a predetermined angle a from the Z-axis direction to the X-axis direction. Since the helical antenna 1 is positioned to have an angle with respect to the circuit substrate 4 in this manner, the capacitive coupling amount due to mutual interference between the helical antenna 1 and the circuit substrate 4 can be changed and thus the antenna impedance can be changed correspondingly. As a result, because of provision of the predetermined antenna angle a, it is possible to adjust the antenna impedance by changing a capacitive coupling value between the helical antenna 1 and the circuit substrate 4.

Performances of the antenna per se such as the directivity for the polarization are equivalent to those in the first embodiment. The directivity of the helical antenna 1 and the directivity of the helical antenna 1 and the circuit substrate 4 for the radio wave which arrives along the ZY plane direction are compensated with each other. Because the antenna unit which is composed of the helical antenna and the dipole antenna can operate based on the electric field components, such antenna unit has the higher antenna gain than the loop antenna which can operate based on the magnetic field components if it is used away from the human body, i.e., in the free space. Like the first embodiment shown in FIGS. 5 and 6, the antenna unit of the second embodiment exhibits the non-directional direction characteristic as the directivity so as to compensate the null point of the directivity of the loop antenna.

According to the second embodiment, like the first embodiment, the high antenna characteristics can always be achieved regardless of the polarization plane of the arrival radio wave and the arrival direction, and particularly the stable and high receiving performance can also be assured even if the antenna unit is used in the free space. Also, the receiving frequency band can be changed without physical change of a length of the helical antenna itself by adjusting the angle $\alpha$ between the helical antenna and the circuit substrate.

[Third embodiment]

Figure 8:
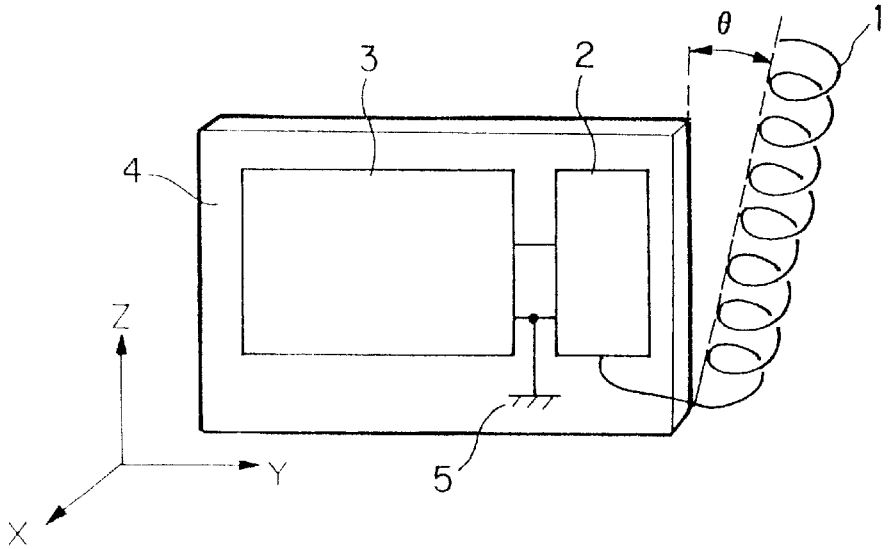
FIGS. 8*a* and 8*b* a schematic view showing a basic configuration of an antenna unit according to a third embodiment of the present invention.
Figure 8:
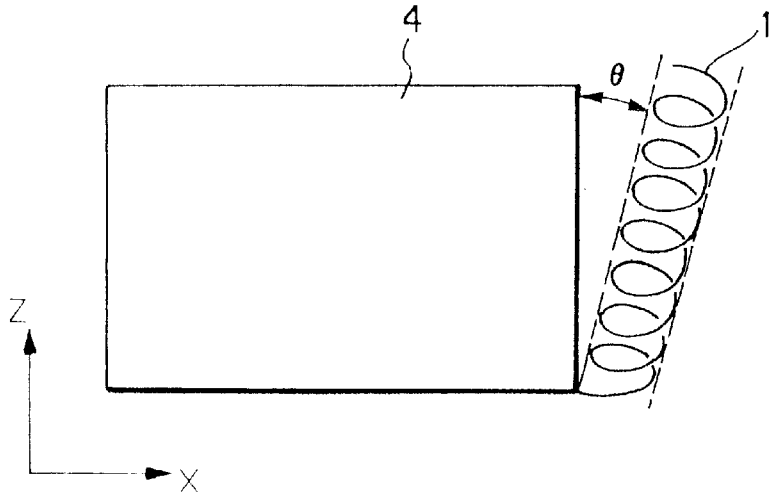

FIG. 8 is a schematic view showing a basic configuration of an antenna unit according to a third embodiment of the present invention. In FIG. 8, (a) is a perspective view of the antenna unit, and (b) is a front view which is viewed from the front side of the circuit substrate.

The antenna unit comprises a helical antenna 1, a matching circuit 2, a receiving circuit 3, and a circuit substrate 4. A GND 5 is ground potential for the matching circuit 2 and the receiving circuit 3 and is also connected to a GND plate which is formed as the inner layer of the circuit substrate 4. A basic configuration of the helical antenna 1 is similar to that in the first embodiment and therefore its detailed explanation will be omitted.

The helical antenna 1 of the third embodiment is arranged to be tilted relative to one side of four sides of the circuit substrate 4, which is positioned in parallel with the ZY plane, by a predetermined angle $\theta$ from the Z-axis direction to the Y-axis direction. Since the helical antenna 1 is positioned to have an angle with respect to the circuit substrate 4 in this manner, the capacitive coupling amount due to mutual interference between the helical antenna 1 and the circuit substrate 4 can be changed and thus the antenna impedance can be changed correspondingly. As a result, because of provision of the predetermined antenna angle $\theta$, it is possible to adjust the antenna impedance by changing the capacitive coupling value between the helical antenna 1 and the circuit substrate 4.

Performances of the antenna itself such as the directivity for the polarization are equivalent to those in the first embodiment. The directivity of the helical antenna 1 and the directivity of the helical antenna 1 and the circuit substrate 4 for the radio wave which arrives along the ZY plane direction are compensated with each other. Because the antenna unit which is composed of the helical antenna and the dipole antenna can operate based on the electric field components, such antenna unit has the higher antenna gain than the loop antenna which can operate based on the magnetic field components if it is used away from the human body, i.e., in the free space. Like the first embodiment shown in FIGS. 5 and 6, the antenna unit of the third embodiment exhibits the non-directional direction characteristic as the directivity so as to compensate the null point of the directivity of the loop antenna.

According to the third embodiment, like the first embodiment, the high antenna characteristics can always be achieved regardless of the polarization plane of the arrival radio wave and the arrival direction, and particularly the stable and high receiving performance can also be assured even if the antenna unit is used in the free space. Also, the receiving frequency band can be changed without physical change of a length of the helical antenna itself by adjusting the angle θ between the helical antenna and the circuit substrate. In the third embodiment, a separating distance between the helical antenna 1 and the circuit substrate 4 can be increased by changing an angle of the helical antenna rather than the second embodiment, and thus an amount of change of the capacitive coupling can be increased. As a result, a change amount of the receiving frequency band can be increased.

[Fourth embodiment]

Figure 9:
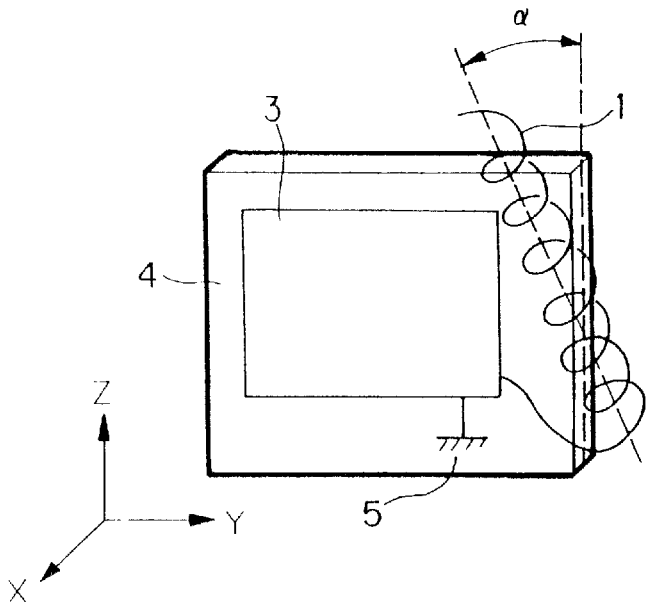
FIGS. 9*a* and 9*b* a schematic view showing a basic configuration of an antenna unit according to a fourth embodiment of the present invention.
Figure 9:
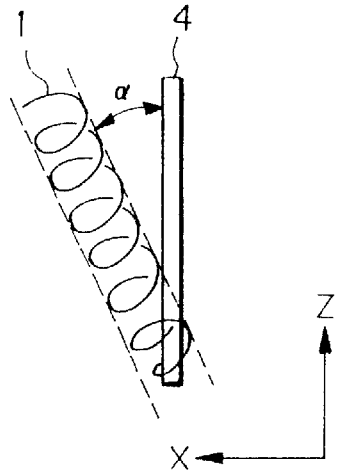

FIG. 9 is a schematic view showing a basic configuration of an antenna unit according to a fourth embodiment of the present invention.

In FIG. 9, (a) is a perspective view of the antenna unit, and (b) is a side view which is viewed from the end surface side of the circuit substrate, on which the helical antenna is provided.

The antenna unit comprises a helical antenna 1, a receiving circuit 3, and a circuit substrate 4. In the present embodiment, no matching circuit is provided between the helical antenna 1 and the receiving circuit 3. A GND 5 is ground potential for the receiving circuit 3 and is also connected to a GND plate which is formed as the inner layer of the circuit substrate 4. A basic configuration of the helical antenna 1 is similar to that in the first embodiment and therefore its detailed explanation will be omitted.

The helical antenna 1 of the fourth embodiment is arranged to be tilted relative to one side of four sides of the circuit substrate 4, which is positioned in parallel with the ZY plane, by a predetermined angle α from the Z-axis direction to the Y-axis direction. Since the helical antenna 1 is positioned to have an angle with respect to the circuit substrate 4 in this manner, the capacitive coupling amount due to mutual interference between the helical antenna 1 and the circuit substrate 4 can be changed and thus the antenna impedance can be changed correspondingly. As a result, because of provision of the predetermined antenna angle α, it is possible to adjust the antenna impedance by changing the capacitive coupling value between the helical antenna 1 and the circuit substrate 4. In this configuration, the antenna characteristics such as the directivity, etc. are also equivalent to those in the first embodiment.

Figure 10:
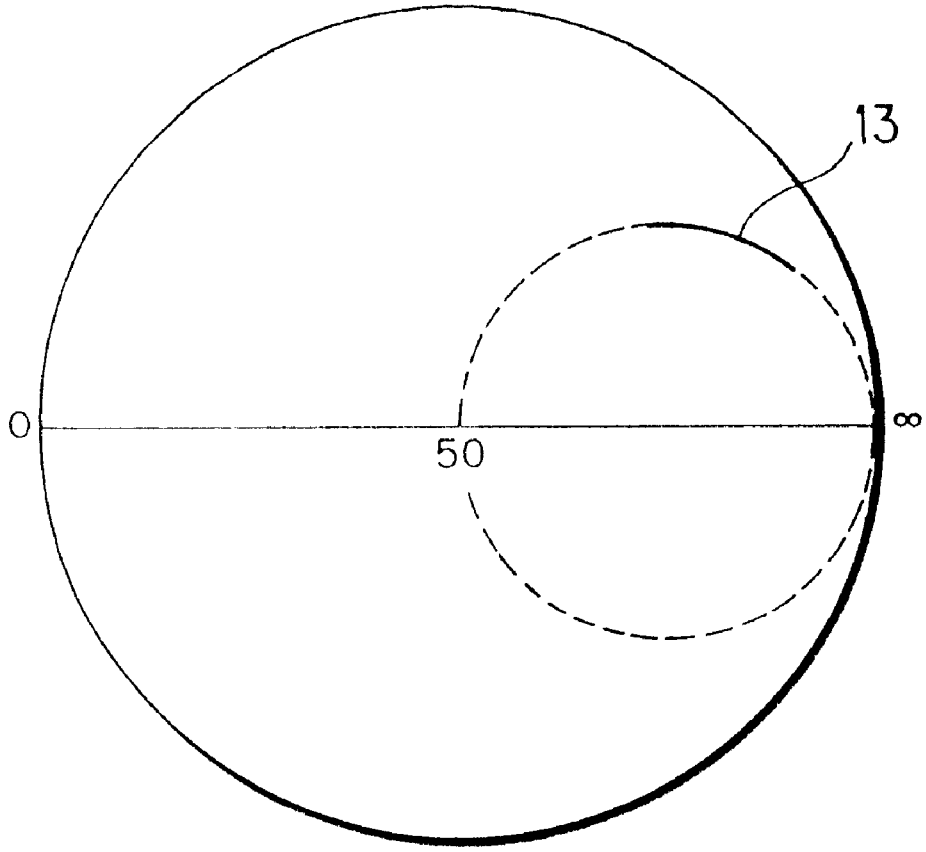
FIG. 10 is a characteristic view showing an impedance on the antenna side.

FIG. 10 is a characteristic view showing an impedance on the antenna side. In the present embodiment, since the antenna impedance can be adjusted as mentioned above, the antenna impedance 13 is not set to 50 Q on the real axis indicated as the horizontal axis in FIG. 10, but set as the inductive impedance which contains an inductance component, as shown in FIG. 10. In other words, the impedance on the antenna side can be set inductively by a single body of the antenna at a desired frequency.

An input impedance of a not-shown low noise amplifier (abbreviated as an "LNA" hereinafter) which is provided at the first stage of the receiver circuit 3 becomes capacitive. Therefore, in the fourth embodiment, the helical antenna 1 is directly connected to an input terminal of the LNA provided at the first stage of the receiver circuit 3. For this reason, since the helical antenna 1 which is set to have an inductive impedance is directly connected to the input terminal of the LNA which has a capacitive impedance, antenna matching which does not need an impedance converter circuit at all can be implemented. In this case, because a packaging area of the matching circuit can be eliminated on both the antenna side and the receiver circuit side, a size reduction of the radio circuit can be brought about to thus make a size of the device smaller.

In this way, according to the fourth embodiment, the matching circuit can be removed from both the antenna circuit side and the receiver circuit side, and therefore both the antenna unit in which the packaging area of the matching circuit is reduced to thus suppress a matching loss to the lowest minimum and the receiver device into which the antenna unit is incorporated can be accomplished. In addition, like the first embodiment, the high antenna characteristics can always be achieved regardless of the polarization plane of the arrival radio wave and the arrival direction, and particularly the stable and high receiving performance can also be assured even if the antenna unit is used in the free space.

[Fifth embodiment]

Figure 11:
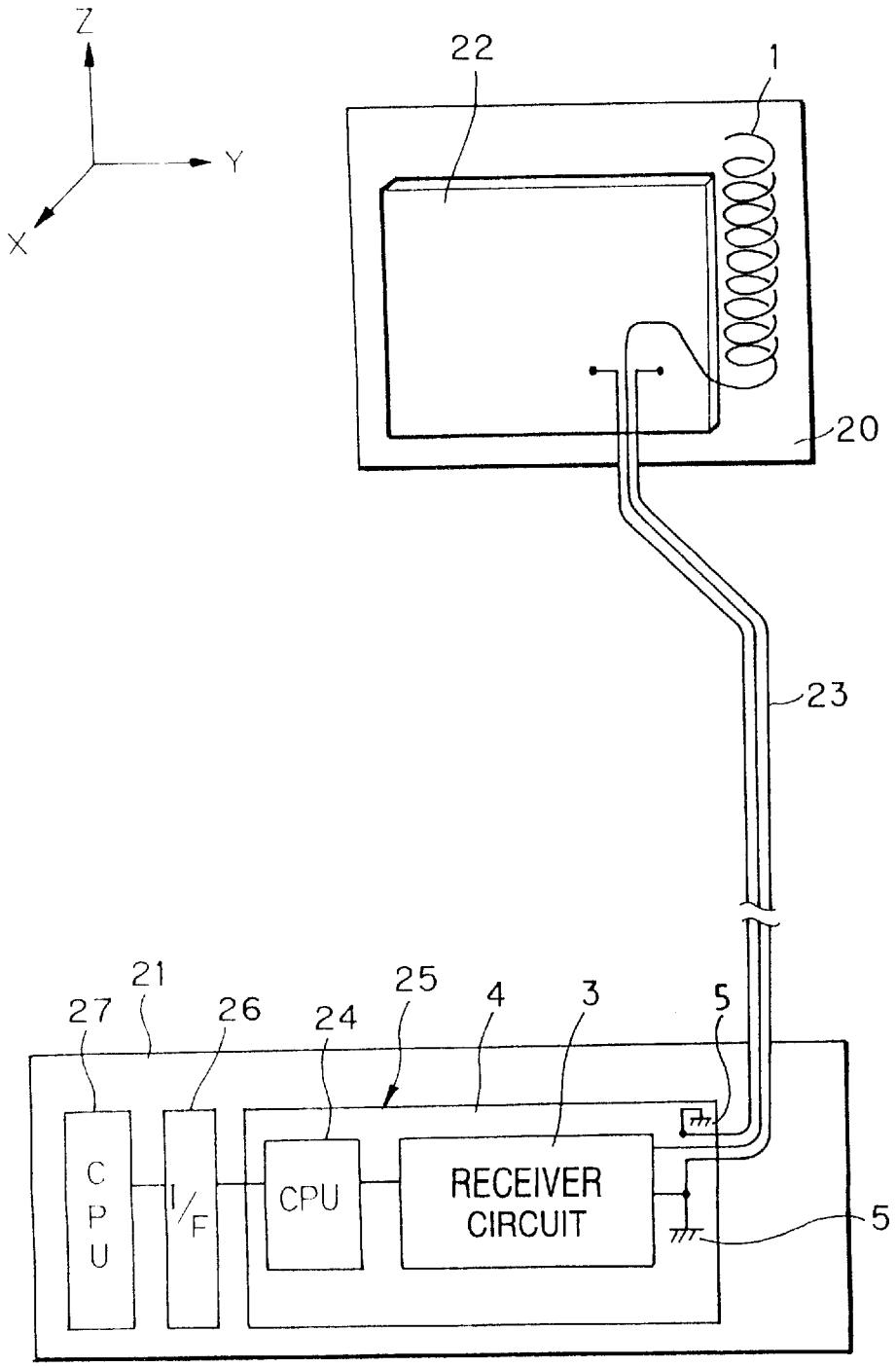
FIG. 11 is a schematic view showing a basic configuration of a radio paging receiver into which an antenna unit according to a fifth embodiment of the present invention is incorporated.

FIG. 11 is a schematic view showing a basic configuration of a radio paging receiver into which an antenna unit according to a fifth embodiment of the present invention is incorporated. The fifth embodiment shows a configurational example wherein the antenna unit is incorporated into the radio paging receiver utilized as an equipment controlling receiver terminal. As a controlled-object device 21, for example, an electric water heating appliances, an air conditioner, etc. are thought about.

In the fifth embodiment, if the circuit substrate 4 into which the receiver circuit 3 of the radio paging receiver 25 is incorporated must be fixed to a location, at which it is difficult to receive the radio wave, because of system arrangement, only the antenna unit for receiving the radio wave is provided separately from a main body of the controlled-object device 21 and then placed on the outside of the controlled-object device 21 as an external antenna unit 20. The external antenna unit 20 consists of the helical antenna 1 and a metal plate 22 made of metal plate material such as a copper plate. A high frequency cable 23 is connected to the external antenna unit 20. The external antenna unit 20 and the receiver circuit 3 are connected at some distance via the high frequency cable 23. In the case of the present antenna consisting of the helical antenna 1 and the metal plate 22, the antenna characteristics such as the directivity, etc. are similar to those in the first embodiment. As described in the fourth embodiment, the impedance on the antenna side can be set inductively at a desired frequency.

An input portion of the receiver circuit 3 is connected to an inner conductor of the high frequency cable 23. The GND 5 provided on the receiver circuit 3 side is connected to an outer conductor of the high frequency cable 23. At the other end of the high frequency cable 23, the helical antenna 1 of the external antenna unit 20 is connected to the inner conductor of the high frequency cable 23 and also the metal plate 22 of the external antenna unit 20 is connected to the outer conductor of the high frequency cable 23. The receiver circuit 3 and a CPU 24 are provided on the circuit substrate 4 of the radio paging receiver 25. The CPU 24 is connected to a CPU 27 via an interface (I/F) 26 of the controlled-object device 21.

The received signal is received by the helical antenna 1 and the metal plate 22, then detected by the receiver circuit 3 of the radio paging receiver 25 via the high frequency cable 23, and then processed by the CPU 24 of the radio paging receiver 25 to be converted into communication data. Then, a control signal issued based on the communication data is transmitted from the CPU 24 of the radio paging receiver 25 to the CPU 27 of the controlled-object device 21 via the interface (I/F) 26 to execute control of the controlled-object device 21 (the electric water heating appliances, the air conditioner, etc.).

In this manner, according to the configuration of the fifth embodiment, even in the case that the circuit substrate into which the receiver circuit of the radio paging receiver is incorporated cannot be positioned on the outer side of the controlled-object device and thus must be positioned on the inner side at which the radio wave is difficult to receive, the high antenna characteristics can always be achieved regardless of the polarization plane of the arrival radio wave and the arrival direction, and particularly the stable and high receiving performance can also be assured even if the antenna unit is used in the free space, like the first embodiment, by the simple configuration in which the external antenna unit merely consisting of the antenna and the metal plate and the controlled-object device side are connected by the high frequency cable.

[Sixth embodiment]

Figure 12:
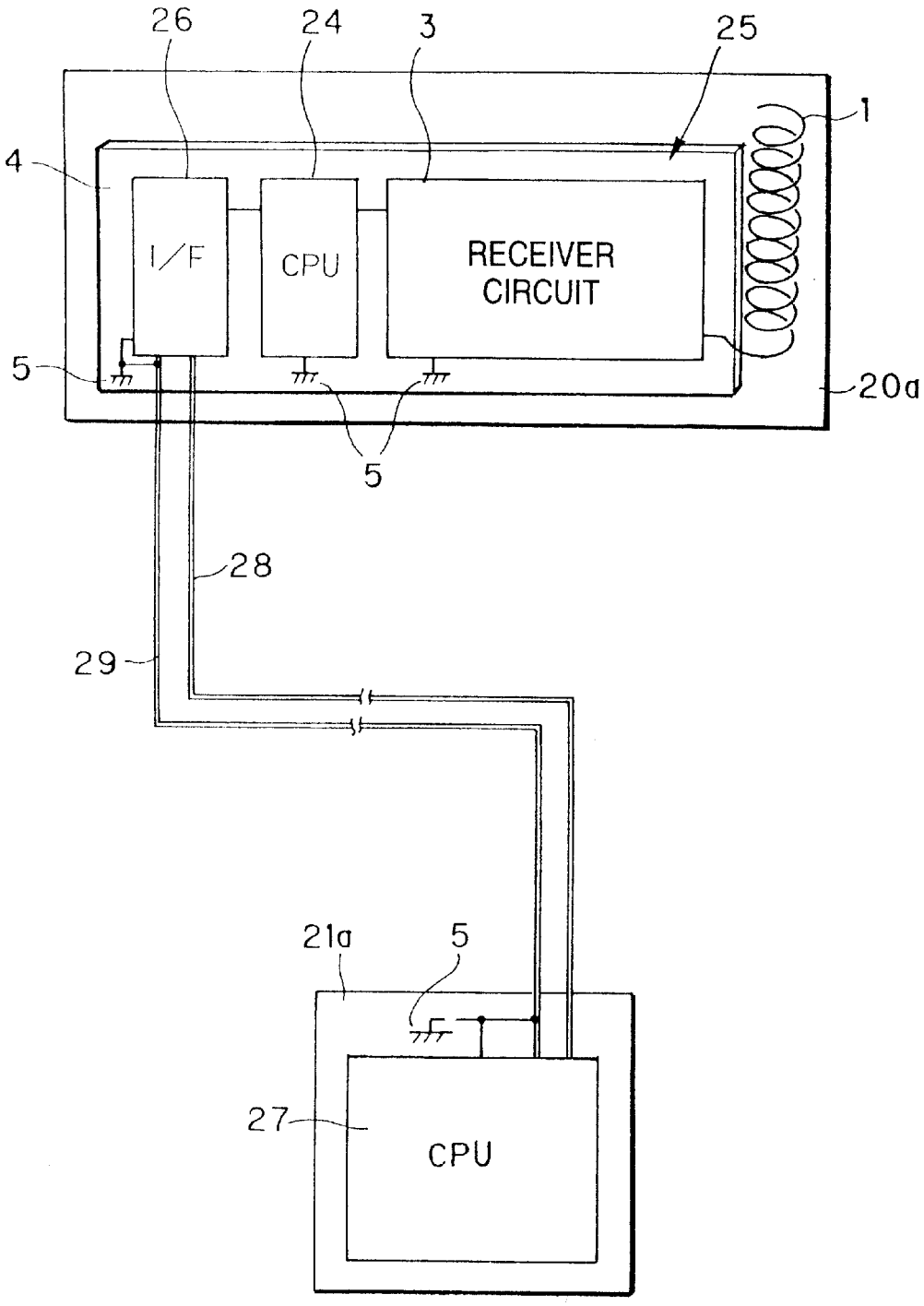
FIG. 12 is a schematic view showing a basic configuration of a radio paging receiver into which an antenna unit according to a sixth embodiment of the present invention is incorporated.
Figure 13:
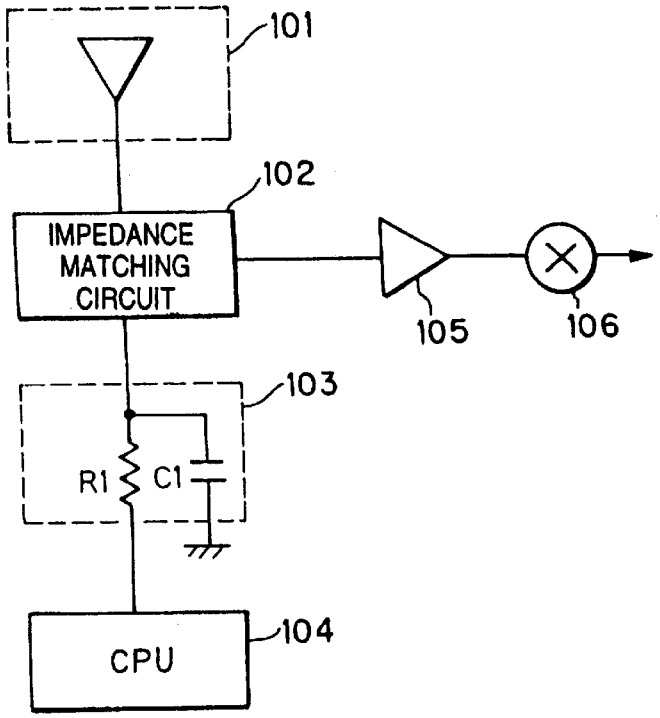
FIG. 13 PRIOR ART
FIG. 13 is a block diagram showing a configuration of an antenna tuning control circuit in the loop antenna.
Figure 14:
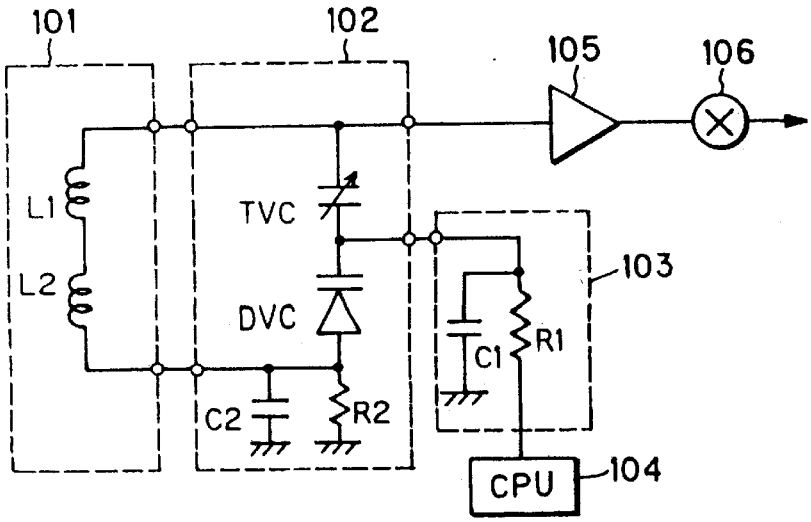
FIG. 14 PRIOR ART
FIG. 14 is a circuit diagram showing a concrete configuration of the circuit shown in FIG. 13.

FIG. 12 is a schematic view showing a basic configuration of a radio paging receiver into which an antenna unit according to a sixth embodiment of the present invention is incorporated. The sixth embodiment shows another configurational example wherein the antenna unit is incorporated into the radio paging receiver utilized as the equipment controlling receiver terminal. As a controlled-object device 21*a*, for example, the air conditioner, etc. are thought about.

In the sixth embodiment, in order to avoid influences caused by the direct noise inputting into the receiver circuit 3 from the controlled-object device 21*a* and the noise inputting into the helical antenna 1, the circuit substrate 4 is fixed as it is to a location (in an external antenna unit 20*a*) at which the radio wave is easy to receive. The receiver circuit 3 and the CPU 24 of the radio paging receiver 25 and the interface 26 are provided on the circuit substrate 4 which is provided to the external antenna unit 20*a*. In contrast, only the CPU 27 is provided on the controlled-object device 21*a* main body side away from the external antenna unit 20*a* into which the receiver circuit 3, the helical antenna 1, etc. are incorporated. The interface 26 of the external antenna unit 20*a* and the CPU 27 of the controlled-object device 21*a* are connected by an equipment controlling signal line 28 and a GND common line 29. Respective GNDs 5 are connected to the GND common line 29. In the case of the present configuration, the antenna characteristics such as the directivity, etc. are similar to those in the first embodiment The received signal is received by the helical antenna 1 and the metal plate 22, then detected by the receiver circuit 3, and then processed by the CPU 24 to be converted into communication data. Then, a control signal issued based on the communication data is transmitted from the interface 26 to the CPU 27 of the controlled-object device 21*a*, which is positioned at a distance via the equipment controlling signal line 28 and the GND common line 29, to execute control of the controlled-object device 21*a* (the air conditioner, etc.).

Like the above, according to the sixth embodiment, the CPU of the controlled-object device is positioned away from the receiver circuit and the helical antenna of the external antenna unit, and then the control signal for the device control derived by detecting and converting the received signal is separated from the controlled-object device by using the equipment controlling signal line and the GND common line. Therefore, the influences caused by the noise which is generated by the controlled-object device and then enters directly into the receiver circuit and the noise which enters into the helical antenna can be avoided. As a result, it is possible to assure the stable receiving performance and, like the first embodiment, the high antenna characteristics can always be achieved regardless of the polarization plane of the arrival radio wave and the arrival direction, and particularly the stable and high receiving performance can also be assured even if the antenna unit is used in the free space by the simple configuration.

According to embodiments described above, in the antenna unit employed in the information receiving terminal, the equipment controlling receiver terminal, etc. to be employed mainly in the free space, since two antennas, i.e., both the helical antenna only and the dipole antenna consisting of the helical antenna and the circuit substrate are provided, there can be provided an antenna unit which is able to exhibit non-directional without the null point in the directivity and assure the high antenna performance in the free space, without the complicated impedance matching circuit in the receiver circuit and the frequency varying circuit for varying a receiving frequency. In this case, it is possible to construct the antenna unit smaller in size and lower in production cost than the loop antenna. Accordingly, it is possible to attain the sufficient antenna characteristics in all directions and also achieve size reduction and simplification in configuration of the unit and achieve reduction in cost.

As described above, according to the present invention, in the antenna unit employed in the information receiving terminal, the equipment controlling receiver terminal, etc. to be employed mainly in the free space, it is possible to provide the antenna unit which can achieve the impedance matching and change the receiving frequency of the antenna unit without the complicated impedance matching circuit, the frequency varying circuit, etc., and can exhibit non-directional without the null point in the directivity and construct the antenna unit smaller in size and lower in production cost than the loop antenna. Accordingly, such advantages can be achieved that can attain the sufficient antenna characteristics in all directions and also achieve size reduction and simplification in configuration of the unit and achieve reduction in cost.

In addition, since the antenna unit is provided separately from the radio receiver device and connected to the outer side of the radio receiver device main body via the cable, the influence of the noise can be avoided and also the stable and desired receiving performance can be assured irrespective of the device configuration.

What is claimed is:

1. An antenna unit comprising:

a circuit substrate on which a receiver circuit is mounted; and a helical antenna connected to the circuit substrate and arranged substantially along one side of the circuit substrate;

wherein impedance of the antenna unit is adjusted at a desired frequency by changing an angle of the helical antenna relative to the circuit substrate.

2. An antenna unit comprising:

a circuit substrate on which a receiver circuit is mounted; and a helical antenna connected to the circuit substrate and arranged substantially along one side of the circuit substrate;

wherein impedance of the antenna unit (can be) is set at a desired frequency by arranging the helical antenna such that an angle of the helical antenna relative to the circuit substrate is set to a predetermined value.

3. An antenna unit according to claim 1, wherein the impedance of the antenna unit is set inductively at the desired frequency.

4. An antenna unit comprising:

a circuit substrate on which a receiver circuit is mounted; and a helical antenna connected to the circuit substrate and arranged substantially along one side of the circuit substrate;

wherein a first antenna consisting of a single body of the helical antenna and a second antenna consisting of the helical antenna and the circuit substrate are arranged such that main polarization directions of the first antenna and the second antenna are intersected substantially orthogonally.

5. An antenna unit comprising:

a circuit substrate on which a receiver circuit is mounted; and a helical antenna connected to the circuit substrate and arranged substantially along one side of the circuit substrate, the helical antenna having an impedance that is adjustable;

wherein an amplifier provided at an input stage of the receiver circuit is directly connected to the helical antenna.

6. An antenna unit comprising:

metal plate material; and a helical antenna connected to the metal plate material and arranged substantially along one side of the metal plate material;

wherein the antenna unit is provided separately from a main body of a radio receiver device in which a receiver circuit is provided, and then the antenna unit is connected to an outer side of the main body of the radio receiver device via a cable and wherein impedance of the antenna unit is adjusted at a desired frequency by changing an angle of the helical antenna relative to the metal plate material.

7. An antenna unit comprising metal plate material; and a helical antenna connected to the metal plate material and arranged substantially along one side of the metal plate material;

wherein the antenna unit is provided separately from a main body of a radio receiver device in which a receiver circuit is provided, and then the antenna unit is connected to an outer side of the main body of the radio receiver device via a cable and wherein the impedance of an antenna side which is detected from a top end of the cable connected to the antenna unit is adjustable inductively at the desired frequency.

8. A radio receiver device using an antenna unit comprising:

an antenna unit including metal plate material, and a helical antenna connected to the metal plate material and arranged substantially along one side of the metal plate material, the helical antenna having an impedance that is adjustable;

wherein the antenna unit is provided separately from a main body of the radio receiver device in which a receiver circuit is provided and then the antenna unit is connected at a distance to an outer side of the main body of the radio receiver device via a cable, and an amplifier provided at an input stage of the receiver circuit is directly connected to the helical antenna.

9. A radio receiver device using an antenna unit comprising:

an antenna unit including a circuit substrate on which a receiver circuit is mounted, and a helical antenna connected to the circuit substrate and arranged substantially along one side of the circuit substrate;

wherein the antenna unit is provided separately from a main body of the radio receiver device and then the antenna unit is connected at a distance to an outer side of the main body of the radio receiver device via a cable.

* * * * *